US006775863B2

(12) United States Patent
Hutchings

(10) Patent No.: US 6,775,863 B2
(45) Date of Patent: Aug. 17, 2004

(54) SPA OR POOL SWITCH

(75) Inventor: Brent Mark Hutchings, Ramona, CA (US)

(73) Assignee: Dimension One Spas, Vista, CA (US)

( * ) Notice: Subject to any disclaimer, the term of this patent is extended or adjusted under 35 U.S.C. 154(b) by 0 days.

(21) Appl. No.: 10/279,380

(22) Filed: Oct. 23, 2002

(65) Prior Publication Data

US 2004/0078886 A1 Apr. 29, 2004

(51) Int. Cl.[7] ..... A47K 3/00

(52) U.S. Cl. ..... 4/541.1; 4/541.2; 4/541.3; 4/541.4; 4/541.5; 4/541.6; 4/491; 4/492; 4/509

(58) Field of Search ..... 4/541.1, 541.2, 4/541.3, 541.4, 541.5, 541.6, 491, 492, 509

(56) References Cited

U.S. PATENT DOCUMENTS

| | | | | |
|---|---|---|---|---|
| 4,233,694 A | * | 11/1980 | Janosko et al. | 4/541.3 |
| 4,780,917 A | * | 11/1988 | Hancock | 4/541.2 |
| 5,195,511 A | * | 3/1993 | Kodato et al. | 601/167 |
| 6,269,493 B2 | | 8/2001 | Sorensen | |

* cited by examiner

*Primary Examiner*—Henry Bennett
*Assistant Examiner*—Azy Kokabi
(74) *Attorney, Agent, or Firm*—Fish & Richardson P.C.

(57) ABSTRACT

A switching assembly that can be used on a spa, pool, bathtub, or aquarium shell without the need to form a hole in the shell. The switching assembly includes an actuator that is mounted on an interior surface of the shell and is exposed at least in part to water held by the shell. The actuator may be mounted above or below the water line. The switching assembly also includes a switch that is responsive to the actuator and is mounted on the opposite, exterior surface of the shell. The switch responds to stimulus from the actuator without the need to form a hole in the shell between the switch and the actuator. The actuator may include a magnet that produces a magnetic field, and the switch may include a reed switch, which changes state in response to the absence or presence of the magnetic field generated by the actuator magnet. The magnet may be supported by a button attached to the shell, and the button protects the magnet from exposure to water and chemicals held in the shell. The switch is also protected from exposure to water and chemicals, as the switch is mounted on the exterior surface of the shell that is not exposed to water and chemicals and no hole is formed in the shell between the switch and the actuator.

18 Claims, 3 Drawing Sheets

SPA OR POOL SWITCH

TECHNICAL FIELD

This invention relates to a switch. More particularly, this invention relates to a magnetic switch that can be used in a spa, hot tub, swimming pool, bathtub, or aquarium.

BACKGROUND

Spas, hot tubs, pools, bathtubs, and aquariums frequently include switches to control various electrical functions, such as pumping and lighting systems. (Those skilled in the art will understand that the terms "spa" and "hot tub" are used interchangeably. For simplicity, the remainder of this description will use only the term "spa," which will be understood to encompass spas and hot tubs.) Conventionally, spas and pools have used mechanical switching assemblies to control such electrical functions. Mechanical switching assemblies, however, require holes to be drilled in the spa or pool shell, creating a potential that water will leak from the spa. Moreover, such mechanical switching assemblies often fail due to water or chemical intrusion into the switching assembly itself.

Accordingly, a need exists for a switching assembly that can be used in spas and pools without drilling the shells and that is not prone to failure due to water or chemical intrusion. The present invention provides such a switching assembly.

SUMMARY

In one aspect, the present invention is an appartus that includes a vessel for holding water and a switching assembly. The vessel has an interior surface and an exterior surface, at least a portion of the interior surface contacting water when the vessel is holding water. The switching assembly includes an actuator attached to the interior surface of the vessel and exposed at least in part to water when water is held by the vessel. The switching assembly also includes a switch attached to the exterior surface of the vessel so as to be protected from exposure to water when water is held by the vessel, the switch for changing state in response to stimulus from the actuator.

In another aspect, the present invention is a spa that includes a spa shell for holding water, an electrical system, and a switching assembly. The spa shell has an interior surface that is exposed to water when water is held by the spa shell and an exterior surface that faces away from water held by the spa shell. The switching assembly controls an aspect of the electrical system and includes: an actuator attached to the interior surface of the spa shell and exposed at least in part to water when water is held by the spa shell; and a switch attached to the exterior surface of the spa shell so as to be protected from exposure to water when water is held by the spa shell, the switch for changing state in response to a magnetic field generated by the actuator.

In another aspect, the present invention is a method of manufacturing a spa or pool that includes at least one electrical system controlled at least in part by a switch. The method includes the following steps: forming a shell having an interior surface that is exposed to water when water is held by the shell and an exterior surface that faces away from water held by the shell; attaching a switch to the exterior surface of the shell; coupling the switch to the electrical system so that the switch can be used to control an aspect of the electrical system; and attaching an actuator that causes the switch to change state to the interior surface of the shell without having to make a hole through the shell.

These are only examples of aspects of the present invention. The details of one or more embodiments of the invention are set forth in the accompanying drawings and the description below. Other features, objects, and advantages of the invention will be apparent from the description and drawings, and from the claims.

DETAILED DESCRIPTION

In the following description, for purposes of explanation, numerous specific details are set forth in order to provide a thorough understanding of the present invention. It will be apparent, however, to one skilled in the art that the present invention may be practiced without these specific details.

The present invention relates to spas, pools, bathtubs, and aquariums. The invention provides a switching assembly that eliminates problems associated with conventional mechanical and electrical switches. For example, the switching assembly of the present invention obviates the need to drill holes in a spa or pool shell through which water may leak. In addition, the switching assembly of the present invention is not prone to water or chemical intrusion, which may degrade the switching assembly and ultimately cause failure. Also, the switching assembly of the present invention may be mounted in a spa, pool, bathtub, or aquarium such that the switching assembly is above or below the water line.

The remainder of this description will refer only to spas and embodiments of the present invention in the context of spas, and not to swimming pools, bathtubs, or aquariums. It will be understood by those skilled in the art, however, that the present invention is not limited to spas, but rather is also useful in other applications in which switching assemblies are placed in or on shells that hold water, such as swimming pools, bathtubs, and aquariums. Thus, the present invention encompasses all such applications.

Figure 1:
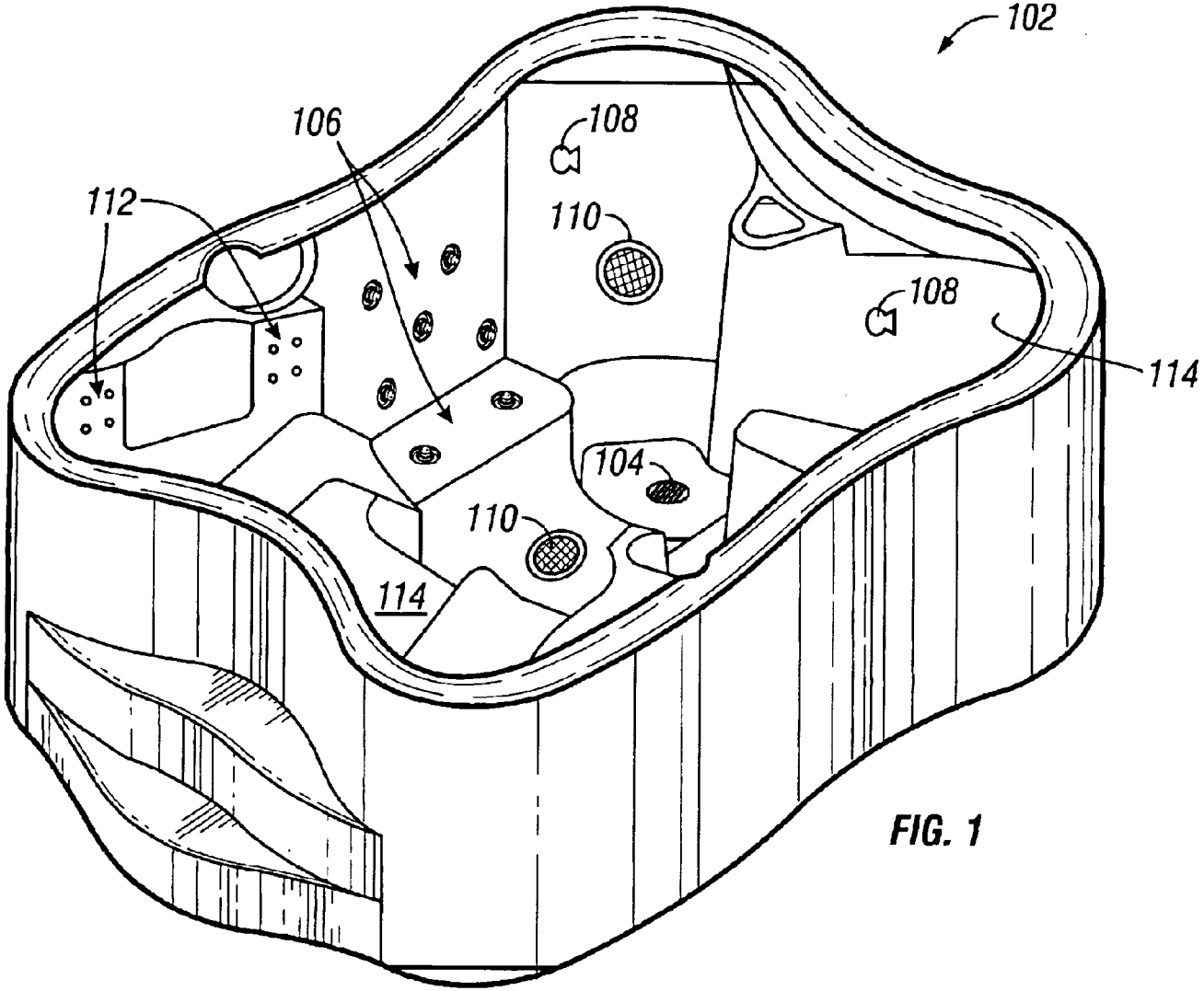
FIG. 1 is a perspective view of a spa having switching assemblies for controlling electrical functions and features of the spa.

FIG. 1 shows a spa 102 that includes two electrical systems, in this example, a pumping system and a lighting system. The spa 102 includes an inlet 104 for the pumping system to remove water from the spa 102. The spa 102 also includes jets 106 and circulation outlets 108 by which the pumping system returns water to the spa 102. In addition, the spa 102 includes lights 110, which are part of the lighting system. As those skilled in the art will appreciate, the spa 102 may have other electrical features, such as a sound system. The pumping and lighting systems are shown here only by way of example. Thus, the present invention encompasses any electrical system that may be used in a spa, swimming pool, or bathtub.

The spa 102 is equipped with several switching assemblies 112 used to control the pumping and lighting systems. For simplicity, the remainder of the description will refer to "switching assemblies." The use of the term "switching assemblies," however, is not intended to be limiting, but rather covers any device that can be used to control an operational aspect of an electrical system. The switching assemblies 112 may be connected, for example, to start and stop the pumping system, to turn the jets 106 on and off, or to enable various features of the pumping system, such as hydrotherapy jets in a massage chair. Those skilled in the art will recognize that the switching assemblies 112 may be used to control any number of features associated with the pumping system. Other switching assemblies 112 may be devoted to turning on and off the lights 110, either all together, individually, or in combinations.

As is shown in FIG. 1, the switching assemblies 112 are located in or on a water vessel 114 (e.g., the spa shell). The shell 114 holds water and may be formed from fiberglass or other suitable material, in known fashion. A portion of the switching assemblies 112 may be protrude from the interior surface of the shell 114 (as shown) to make them easily accessible to spa users when they are in the spa 102. However, with conventional switches, the shell 114 must be drilled to accommodate the switching assemblies 112. Moreover, placement of the switching assemblies 112 as shown exposes the portion of the switching assemblies 112 protruding from the interior of the shell 114 to water and spa chemicals, potentially causing damage to conventional switches. If the switching assemblies 112 are mounted below the water line, they are constantly exposed to water and chemicals. If the switching assemblies are mounted above the water line, they will be exposed periodically to water and chemicals, for example, from splashing.

As stated above, the switching assembly of the present invention eliminates the problems associated with conventional switches. The present invention provides a switching assembly for which holes need not be drilled in the shell 114. Without holes in the spa shell 114, the inventive switching assembly is essentially impervious to the deleterious effects of water and chemical penetration and exposure.

Figure 2:
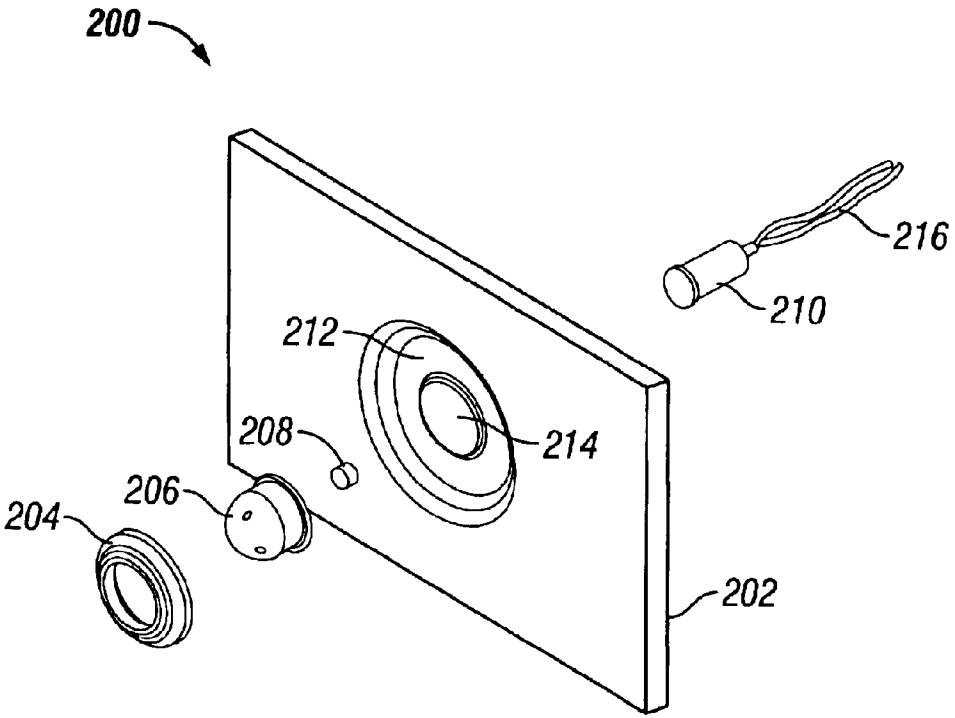
FIG. 2 is a perspective view of a switching assembly, in accordance with an embodiment of the present invention, prior to final assembly.

FIG. 2 shows an exploded view of an embodiment of the switching assembly 200 of the present invention. The exploded view illustrates not only the components of the inventive switching assembly 200, but also a mechanism by which the switching assembly 200 may be mounted to a spa shell 202. The switching assembly 200 includes an actuator, including, in the preferred embodiment, a retaining ring (or bezel) 204, a button 206 (preferably a rubber push-button), and a magnet 208. The actuator is mounted on one surface of the spa shell 202. The switching assembly 200 also may include a switch 210 (preferably, a reed switch) with associated wiring 216. (The remainder of the description will refer to "reed switches" for convenience.) The reed switch 210 is mounted on the opposite surface of the spa shell 202 in close proximity to the actuator, i.e., essentially opposite one another on the spa shell 202. The reason for the proximal relationship between the actuator and the reed switch 210 will become apparent in the description provided below.

It will be appreciated by those skilled in the art that the use of a rubber push-button 206 in this embodiment is merely a design choice. Any kind of flexible material could be used. Moreover, as those skilled in the art will appreciate, mechanisms other than a flexible button may be used to suspend or hold the magnet 208 such that the magnet 208 can be selectively moved toward and away from the reed switch 210. For example, a spring-loaded plastic switch may be used instead of the rubber push-button shown in FIG. 2. As shown, the device (e.g., button 206) that supports the magnet 208 is exposed to water and chemicals held in the spa shell 202, but at the same time the device protects the magnet 208 from exposure to water and chemicals.

The reed switch 210 contains ferromagnetic contact blades (reed-like), hermetically sealed in an envelope that is filled with an inert gas, in known fashion. Reed switches are available commercially, for example, from Reed Switch Developments Corp., 1405 $16^{th}$ Street, Suite 2170, Racine, Wis. A suitable reed switch 210 for use in the present invention would be Series 2100 or 2104 from Reed Switch Developments Corp., although these specific switches are not intended to be limiting. The reed switch 210 is actuated by an externally generated magnetic field from the actuator 208. The reed switch 210 will change state when the magnet 208 comes into close proximity with the reed switch 210. Because the reed switch 210 and magnet 208 need not make physical contact for the reed switch 210 to change state, the magnetic switching assembly 200 can be mounted on the spa shell 202 without drilling holes. As those skilled in the art will appreciate, the operating distance between the reed switch 210 and magnet 208 can be varied by the choice of magnet 208. Thus, different magnets 208 can be used depending on the thickness of the spa shell 202.

Figure 3:
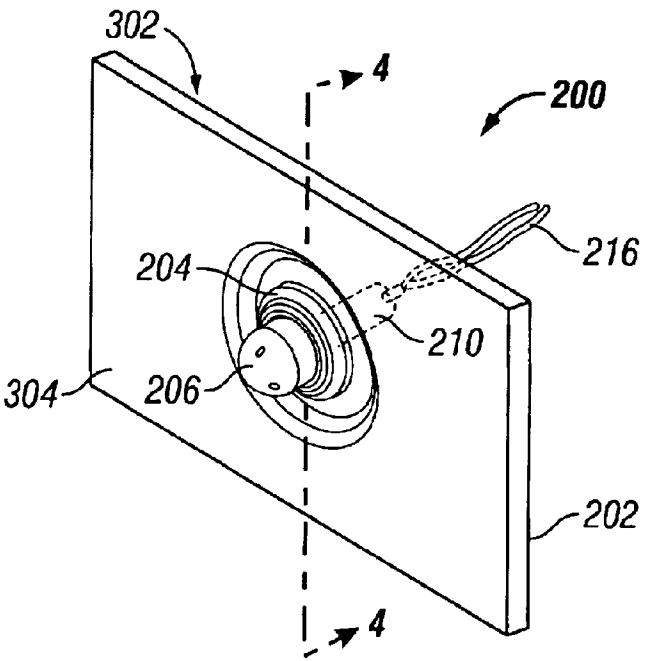
FIG. 3 is a perspective view of the switching assembly of FIG. 2 after assembly.
Figure 4:
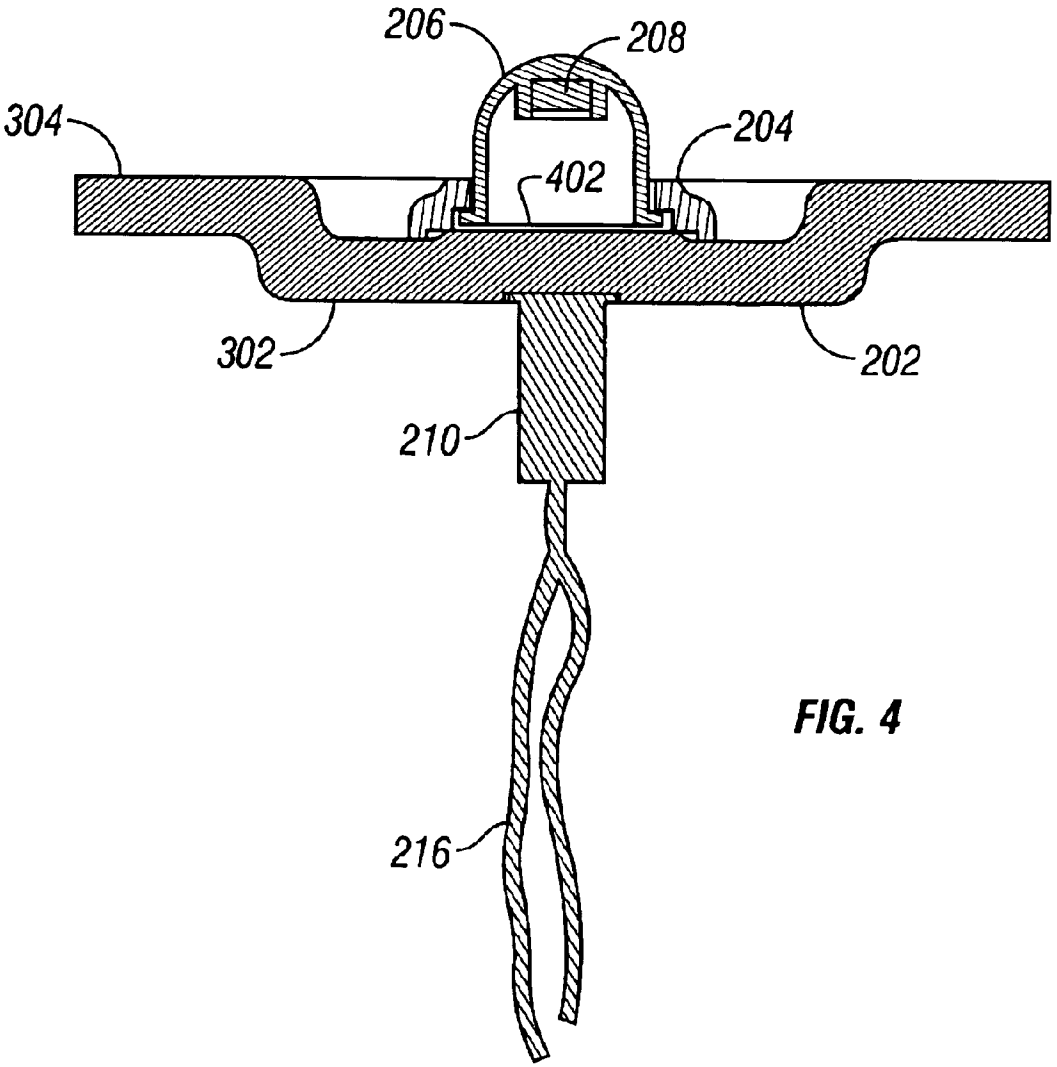
FIG. 4 is a cut-away side view of the assembled switching assembly of FIG. 3, taken along line 4—4.

When assembled, the switching assembly 200 is attached to the spa shell 202 without the need for a hole, as shown in FIGS. 2–4. In the preferred embodiment, a circular indentation 212 with a concentric protrusion 214 may be formed on the spa shell 202 to enable mounting of the switching assembly 200. However, the circular indentation 212 and the protrusion 214 are not required features of the present invention. One skilled in the art will recognize that the switching assembly 200 may be attached to the spa shell 202 without the indentation 212 or protrusion 214. As shown in FIGS. 3 and 4, the reed switch 210 is mounted to the exterior surface 302 of the spa shell 202 (i.e., the surface that does not come into contact with the spa water), while the actuator—e.g., the retaining ring 204, button 206, and magnet 208—are mounted on the interior surface 304 of the spa shell 202 (i.e., the surface exposed to the spa water). Positioning the reed switch 210 on the exterior surface 302 of the spa shell 202 shields the reed switch 210 from water and chemicals, reducing the chance of failure caused by moisture or chemical penetration. Moreover, this configuration allows the button 206 to be located in any position desired within the spa shell 202, even below the waterline, for example, on an underwater armrest for easy and convenient access by the spa user.

FIG. 4 is a cut-away view of the embodiment of the switching assembly 200 shown in FIGS. 2 and 3. As shown in FIG. 4, the reed switch 210 is attached to the exterior surface 302 of the spa shell 202. The reed switch 210 may be attached to the exterior surface 302 of the spa shell 202 by adhesive or other suitable means, such as by molding the reed switch 210 into the spa shell 202. In addition, the button 206 with suspended magnet 208 may be attached to the interior surface 304 of the spa shell 202 by the retaining ring 204, which itself may be attached to the spa shell 202 by adhesive or other suitable means. Alternatively, the retaining ring 204 may be molded directly from the spa shell 202. Those skilled in the art will appreciate that the illustrated means for attaching the button 206 and magnet 208 to the spa shell 202 is merely exemplary; other suitable mechanisms may be used to attach the button 206 and magnet 208 to the spa shell 202. In addition, those skilled in the art will appreciate that the actuator need not include the retaining ring 204, which is simply a preferred mechanism for attaching the button 206 and magnet 208 to the interior surface 304 of the spa shell 202.

As shown in FIG. 4, the magnet 208 may be held within a chamber formed on the inside of the button 206. Consequently, depressing the button 206 causes the magnet 208 to approach an area 402 on the spa shell 202 opposite of the reed switch 210. When the magnet 208 comes into close enough proximity with the reed switch 210, the magnetic field created by the magnet 208 travels through the spa shell 202 and causes the reed switch 210 located on the other side to change state. For example, if the reed switch 210 is connected by wiring 216 to a spa pump (not shown), the reed switch 210 may change state from "PUMP-ON" to "PUMP-OFF." Thus, when the reed switch 210 is in the PUMP-OFF state, if the button 206 is depressed causing the magnet 208 to approach the spa shell area 402, the reed switch 210 will change state to PUMP-ON, causing the pump to commence operation. In this manner, the reed switch 210 may be used to start, stop, or cycle through the features or functions of a spa. Note that the wiring 216 of the reed switch 210 need not be directly connected to the spa pump or other electrical system, but rather electrical signals generated by the reed switch 210 may be conveyed to the electrical system in a wireless manner, in known fashion.

A number of embodiments of the invention have been described. Nevertheless, it will be understood that various modifications may be made without departing from the spirit and scope of the invention. For example, the button 206 may be attached on the spa shell 202 without the use of the circular indentation 212 and the concentric protrusion 214. In addition, the switching assembly 200 can be used to control any number of spa features and functions. Accordingly, other embodiments are within the scope of the following claims.

What is claimed is:

1. An apparatus, comprising:

a vessel for holding water, the vessel having an interior surface and an exterior surface, at least a portion of the interior surface for contacting water when the vessel is holding water; and a switching assembly that is capable of passing control information through a region of the interior surface, without having a hole through the interior surface in the region, the switching assembly including:

an actuator attached to the interior surface of the vessel and exposed at least in part to water when water is held by the vessel, and a switch attached to the exterior surface of the vessel so as to be protected from exposure to water when water is held by the vessel, the switch for changing state in response to stimulus from the actuator.

2. The apparatus of claim 1 wherein the vessel is a spa shell, and the switching assembly controls at least one hydrotherapy jet integral to the apparatus and proximate to the switching assembly.

3. The apparatus of claim 1 wherein the vessel is a pool shell.

4. The apparatus of claim 1 wherein the actuator is attached to the interior surface within an indentation formed in the interior surface, and the actuator includes:

a button; and a magnet supported by the button and protected by the button from exposure to water held in the vessel, the magnet for generating a magnetic field that travels through the vessel and causes the switch to change state.

5. The apparatus of claim 4 wherein the switch includes a reed switch for changing state when the magnet comes into close proximity with the reed switch.

6. The apparatus of claim 5 wherein the button includes a push-button for moving the magnet toward and away from the reed switch.

7. The apparatus of claim 6 wherein the at least a portion of the push-button is made from rubber, the switching assembly further comprising a retaining ring for attaching the push-button to the interior surface of the vessel.

8. A spa, comprising:

a spa shell for holding water, spa shell having an interior surface that is exposed to water when water is held by the spa shell and an exterior surface that faces away from water when water is held by the spa shell;

an electrical system; and a switching assembly for controlling an aspect of the electrical system, the switching assembly being capable of passing control information through a region of the spa shell that is below a waterline of the spa shell, without having a hole through the spa shell in the region, and the switching assembly including:

an actuator attached to the interior surface of the spa shell and exposed at least in part to water when water is held the spa shell, and a switch attached to the exterior surface of the spa shell so as to be protected from exposure to water when water is held by the spa shell, the switch for changing state in response to a magnetic field generated by the actuator.

9. The spa of claim 8 wherein the actuator includes a button and a magnet supported by the button, the button protecting the magnet from exposure to water when water is held by the spa shell, the magnet generating an electrical field that travels through the spa shell and causes the switch to change state.

10. The spa of claim 9 wherein the switch is a reed switch.

11. The spa of claim 10 wherein the button includes a push-button made at least in part from rubber the push-button for moving the magnet toward and away from the reed switch.

12. The spa of claim 8, wherein the actuator is attached to the interior surface within an indentation formed in the interior surface below the waterline in an armrest of a seat in the spa shell.

13. The spa of claim 12, wherein the switching assembly controls at least one hydrotherapy jet integral to the spa.

14. An apparatus, comprising:

a shell for holding water, the shell having an interior surface and an exterior surface, at least a portion of the interior surface for contacting water when the shell is holding water; and a switching assembly that is capable of passing control information through a region of the interior surface, without having a hole through the interior surface in the region, the switching assembly including:

actuating means attached to the interior surface of the shell for generating a stimulus, and switching means attached to the exterior surface of the shell so as to be protected from exposure to water when water is held by the shell, the switching means for changing state in response to the stimulus generated by the actuating means.

15. The apparatus of claim 14 wherein the actuating means includes:

magnetic means for generating a magnetic field that travels through the spa shell and causes the switching means to change state; and means for supporting the magnetic means and for protecting the magnetic means from exposure to water held in the shell.

16. The apparatus of claim 15 wherein the switching means includes a reed switch for changing state when the magnetic means comes into close proximity with the reed switch.

17. The apparatus of claim 14, wherein the actuating means attaches to the interior surface within an indentation formed in the interior surface.

18. The apparatus of claim 14, wherein the switching assembly controls at least one hydrotherapy jet integral to the apparatus.

* * * * *